United States Patent [19]

Woerz

[11] 4,375,969

[45] Mar. 8, 1983

[54] METHOD FOR FORMING A COMPOSITE CONTAINER INCLUDING A REVERSELY CURLED BODY MEMBER

[75] Inventor: Stephen E. Woerz, Florissant, Mo.

[73] Assignee: Boise Cascade Corporation, Boise, Id.

[21] Appl. No.: 238,960

[22] Filed: Feb. 27, 1981

Related U.S. Application Data

[62] Division of Ser. No. 95,528, Nov. 19, 1979, Pat. No. 4,299,350.

[51] Int. Cl.[3] ..... B31B 17/60

[52] U.S. Cl. ..... 493/158; 493/108

[58] Field of Search ..... 493/158, 159, 108, 104, 493/103, 102, 109; 229/5.5, 5.6, 5.7, 5.8, 43, 4.5; 220/306, 74; 215/344

[56] References Cited

U.S. PATENT DOCUMENTS

| | | | |
|---|---|---|---|
| 266,533 | 10/1882 | Sangster | 220/74 |
| 464,385 | 12/1891 | Palmer | 220/74 X |
| 2,250,799 | 7/1941 | Harrison | 493/158 X |
| 3,358,875 | 12/1967 | Ekstrom | 220/74 X |
| 4,190,187 | 2/1980 | Nelms | 229/5.5 |

*Primary Examiner*—James F. Coan

*Attorney, Agent, or Firm*—Laubscher, Philpitt & Laubscher

[57] ABSTRACT

An improved composite container is disclosed including a tubular fibrous body wall having at its upper end a reversely curled portion the upper extremity of which is radially inwardly compressed in such a manner as to form an annular external locking projection by means of which a synthetic plastic closure cap may be fastened to close the container. Preferably the closure member is connected with the container by a tearable tamperproof connection including a radially inwardly directed annular rib that is locked beneath the annular body projection to maintain the closure cap on the container. A method is also disclosed for forming the container body, including the steps of radially outwardly curling the upper end of the body member, radially inwardly compressing the upper extremity of the reversely curled portion, and mounting a synthetic plastic snap-type closure member on the compressed curled end. In one embodiment, a circumferential recess is formed (for example, by skiving) in the outer surface of the tubular fibrous body wall prior to the reverse curling step, whereby the upper extremity of the reversely curled portion is radially inwardly compressed into the recess.

3 Claims, 24 Drawing Figures

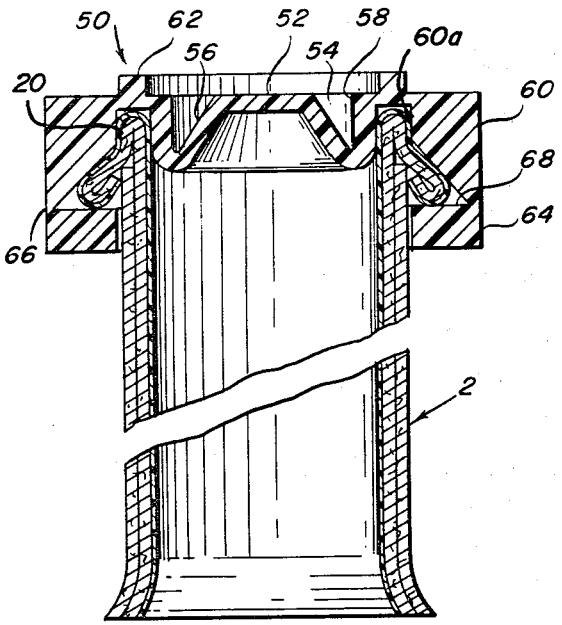
Fig. 5
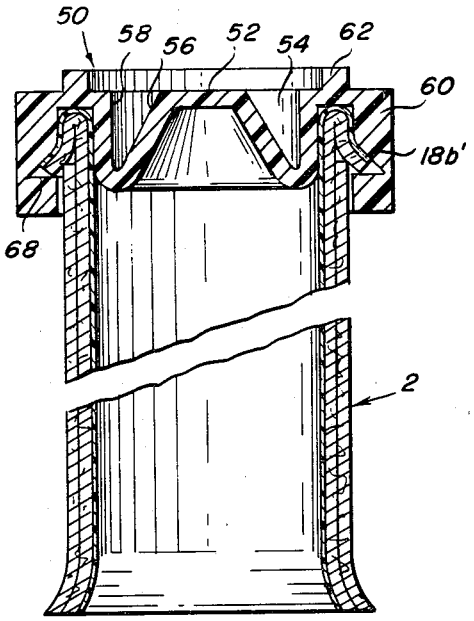
Fig. 7
Fig. 8a
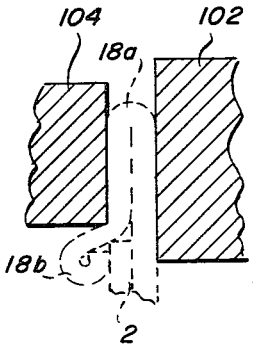
Fig. 8b
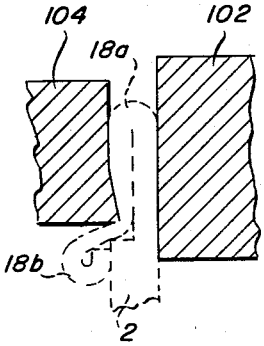
Fig. 8c
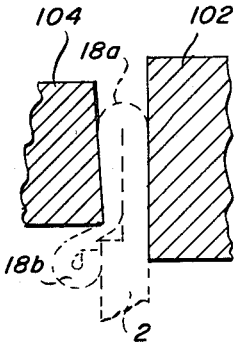
Fig. 8d
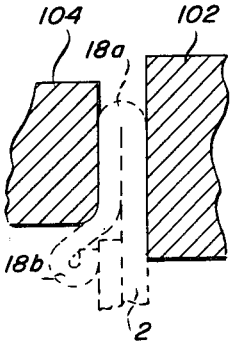
Fig. 8e
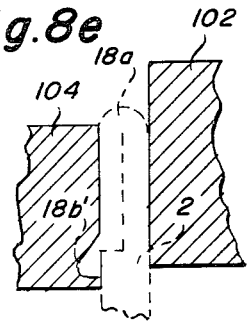
Fig. 8f
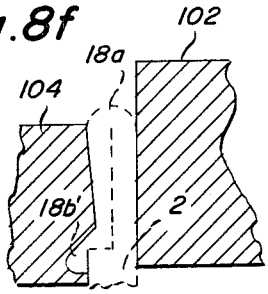
Fig. 8g
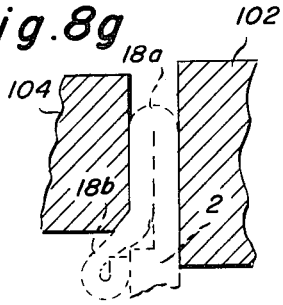

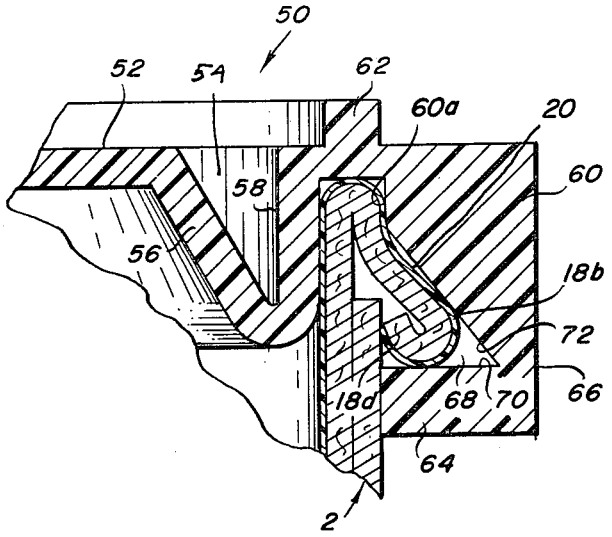
Fig. 6
Fig. 13
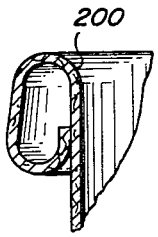
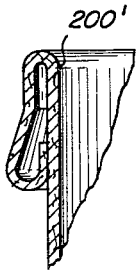
Fig. 14
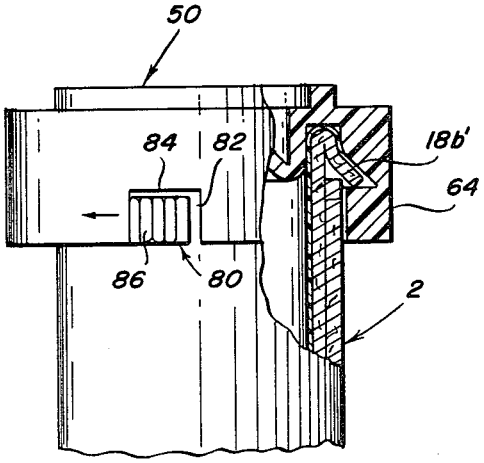
Fig. 9
Fig. 15
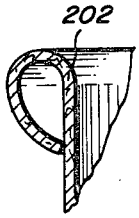
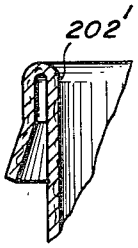
Fig. 16

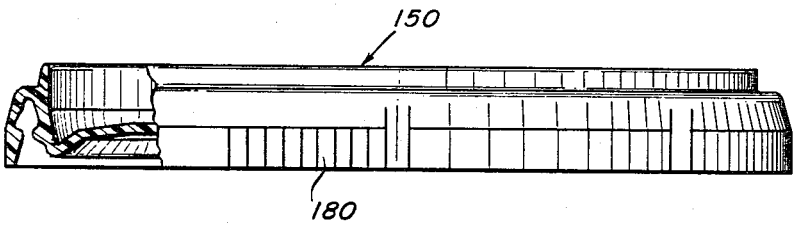
Fig. 10
Fig. 11
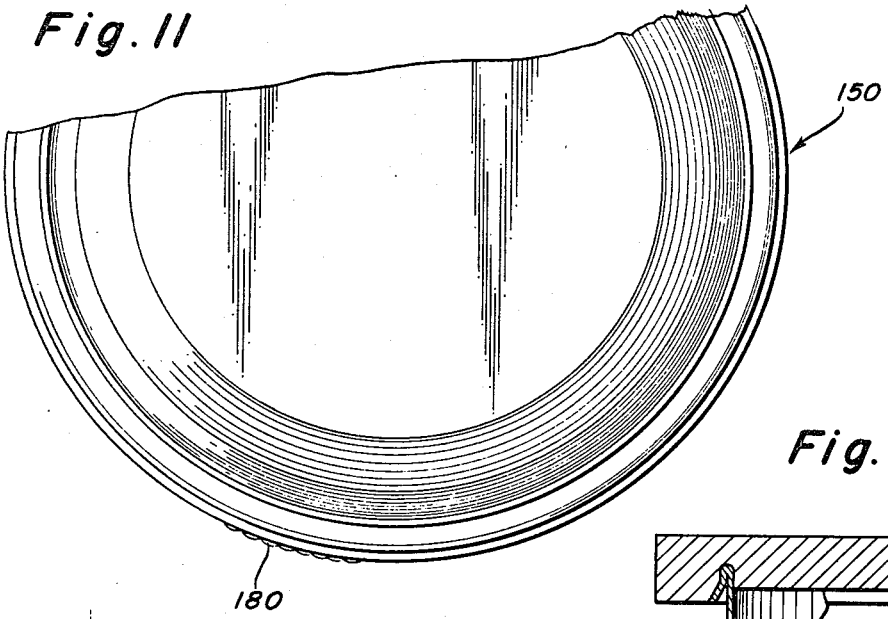
Fig. 17
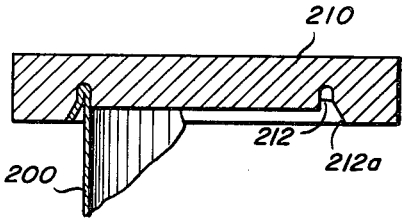
Fig. 12
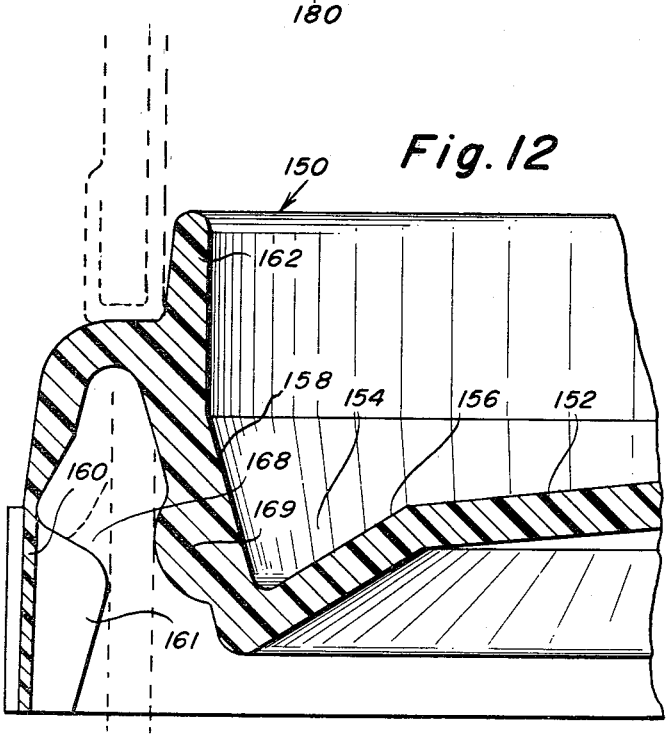
Fig. 18
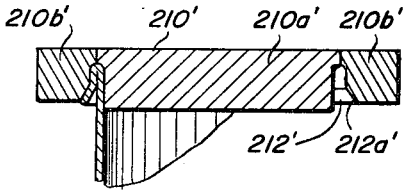

METHOD FOR FORMING A COMPOSITE CONTAINER INCLUDING A REVERSELY CURLED BODY MEMBER

This application is a division of Ser. No. 06/095,528 filed Nov. 19, 1979, now U.S. Pat. No. 4,299,350.

BRIEF DESCRIPTION OF THE PRIOR ART

As evidenced by the prior patents to Balocca U.S. Pat. No. 3,142,433 and Slomski 3,330,436 and 3,336,269, it has been proposed in the prior art to provide composite containers for frozen juice concentrates wherein a pull strip (i.e., a "Mira strip") is arranged between the metal end closure member and the tubular composite body wall, whereby upon the progressive removal of the pull strip, the metal end closure member is removed from the fibrous body wall. One problem with the "Mira strip" ends is that the pull tab becomes slippery when wet, thereby causing difficulty in opening. Also, owing to the increase in the cost of metal, it has become desirable to replace the metal closure member with synthetic plastic closure members, as evidenced, for example, by the U.S. Pat. Nos. to Ruch 3,753,511 and Aichinger et al 4,016,996 (both held by Albert Obrist & Co.) and Johnson et al 3,892,351.

A composite container and method for forming the same wherein an outer circumferential end portion of one body end is removed (for example, by skiving) before curling the body end is disclosed in the U.S. Pat. No. to Ellerbrock et al 3,882,763. In the Ellerbrock patent, an outer circumferential end portion of the body end is removed to define a projecting portion which is then radially outwardly folded at its midpoint and compressed to a flat condition. This end structure is particularly useful as an intermediate end structure during the application of metal ends to the container wherein the body end is again curled to attach the metal end member to the body member end. The Ellerbrock container and method for making the same, however, is not generally suitable for the application of a removable synthetic plastic closure member.

SUMMARY OF THE INVENTION

Accordingly, it is a primary object of the present invention to provide an improved composite container for the packaging of products such as frozen juice concentrate, characterized in that one end of the fibrous body wall member is reversely outwardly curled and radially inwardly compressed to define an annular locking projection to which a synthetic plastic closure member may be fastened. If desired, the outer surface of the body wall member may be provided with a circumferential recess into which the reversely curled portion is radially inwardly compressed. In this embodiment, the composite container is formed by first removing (by skiving) an outer circumferential body portion of one end of the body member to define a tubular inner projecting portion and an outer circumferential recess on the body one end. The inner projecting portion is then reversely outwardly curled concentrically about the body one end to a position in which the free extremity of the inner projecting portion extends in overlapping relation beyond the adjacent end wall of the recess. The upper end of the curled end is then radially inwardly compressed into the recess to cause the lower end of the reversely curled inner projecting portion to extend radially outwardly forming an annular locking projection. The compressing step is normally accomplished either by a conventional can seamer using steel rolls which compress the curled portion and form the curl to the desired shape, or by means of a stationary forming die into which the reversely curled fibrous body wall member is axially displaced.

According to another feature of the invention, a synthetic plastic closure member—including a top portion and an outer dependent flange portion adapted for engagement with the annular locking projection—is applied to the reversely curled body end. Owing to the curled and compressed nature of the body one end, the reversely curled portion is resilient, causing it to "spring back" radially outwardly against the outer locking rib portion, thereby resulting in a tighter and stronger seal between the body member and the closure member. The closure member includes a tearable strip that carries the locking rib means that extend beneath the annular outwardly extending locking projection on the body wall member, whereby upon tearing away of the tear strip, the closure member may be easily lifted from the fibrous body wall member.

According to a further object of the invention, a reclosable container is provided which, after the overcap member has been removed for the discharge of a portion of the contents from the container, permits reclosing of the container by the plastic overcap with a positive tight seal, thereby protecting the container contents.

BRIEF DESCRIPTION OF THE DRAWING

Other objects and advantages of the invention will become apparent from a study of the following specification when viewed in light of the accompanying drawing in which:

FIG. 5 is a cross-sectional view of the container of FIG. 4 having a synthetic plastic closure member mounted thereon;

FIG. 6 is a detailed cross-sectional view of the container of FIG. 5;

FIG. 7 is a cross-sectional view of a modification of the container of FIG. 5;

FIGS. 8*a*–8*g* are cross-sectional views showing various embodiments of the forming roll as used during the compressing steps;

FIG. 9 is a partially broken away side elevational view of the container of FIG. 7 illustrating the pull tab means;

FIG. 10 is a partially sectioned side elevational view of a preferred form of the synthetic plastic closure member;

FIGS. 11 and 12 are top plan and detailed sectional views, respectively of the overcap member of FIG. 10;

FIGS. 13 and 14 are detailed views illustrating the formation of a first embodiment of a reversely rolled non-skived fibrous body wall member;

FIGS. 15 and 16 are detailed views illustrating the formation of a second embodiment of a reversely rolled non-skived fibrous body member; and FIGS. 17 and 18 illustrate two embodiments of stationary forming die means for radially compressing inwardly the reversely rolled end of the fibrous body wall member.

DETAILED DESCRIPTION

Figure 1:
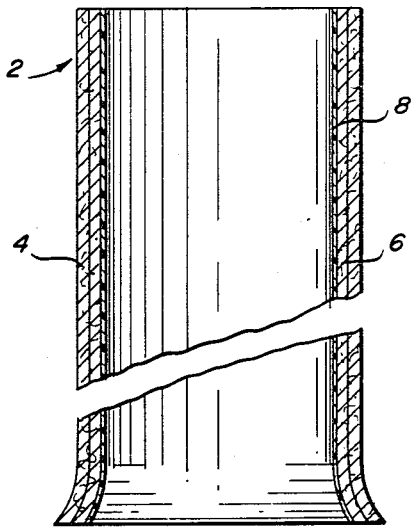
FIG. 1 is a cross-sectional view of a composite body member.
Figure 2:
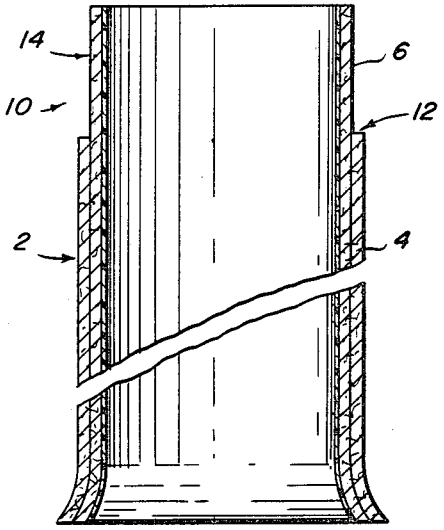
FIG. 2 is a cross-sectional view of the body member of FIG. 1 after external skiving of the upper end thereof.
Figure 3:
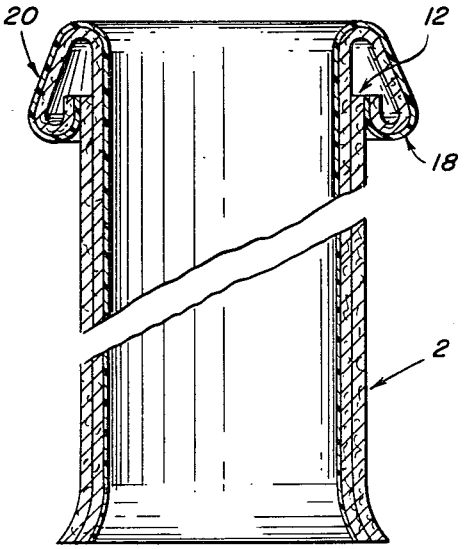
FIG. 3 is a cross-sectional view of the body member of FIG. 2 following reverse outward curling of the skived end.
Figure 4:
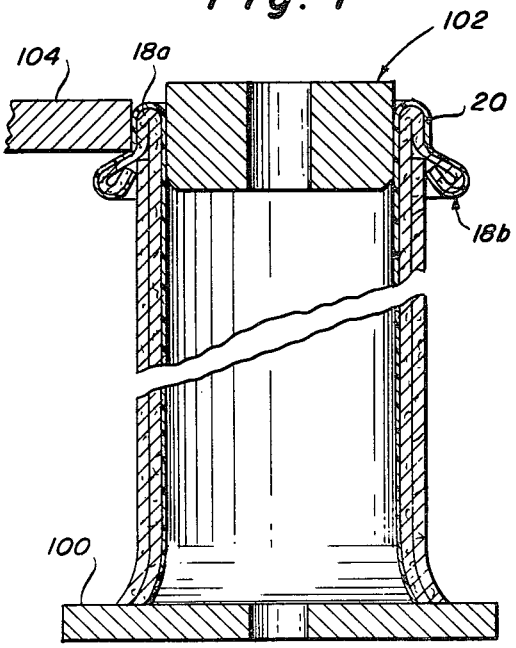
FIG. 4 is a cross-sectional view illustrating the means for radially compressing inwardly the upper portion of the curl.

Referring first to FIG. 1, the composite container of the present invention includes a conventional generally tubular body wall member 2 including fibrous (i.e., Kraft paper) layers 4 and 6, and an impervious inner liner layer 8 (of aluminum foil, or other appropriate material for example). As shown in FIG. 2, at one end of the body wall member an outer circumferential end portion is removed (for example, by skiving) to form a recess 10 having an end wall or shoulder 12, which recess defines a tubular inner projecting portion 14. While the recess 10 is preferably formed by skiving (i.e., by cutting with a rotary tool), it may also be formed by severing the outer fibrous layer 4, heating the end to melt the thermoplastic seal between fibrous layers 4 and 6, and axially removing the severed portion of layer 4 to form the recess 10. In either case, the upper end of the inner projecting portion 14 is then radially outwardly curled (as shown in FIG. 3) concentrically about the body end to a position in which the free extremity of the inner projecting portion extends downwardly in overlapping relation beyond the adjacent end wall 12 of the recess 10. Curling may be accomplished using conventional end seaming means, as disclosed in the Ellerbrock U.S. Pat. No. 3,882,763. In the embodiment of FIG. 3, the free extremity of the overlapped portion of the inner projection portion is itself inwardly reversely curled and engages the body member at a point adjacent the end wall 12, thereby to define a body end including an annular double curl 18. The body member is then mounted on a rotatable base plate 100 (FIG. 4), and the upper end of annular curl 18 is then compressed and formed by a can chuck 102 and forming roll 104. Rotation of the top chuck 102 causes rotation of the body member 2, the roll 104 being cammed into the illustrated position to radially inwardly compress the upper portion **18*a* of the curl into the recess 10 to define a formed curl having a flat outer circumferential surface 20, and a radially outwardly extending annular locking projection 18*b*. The forming roll 104 may have a flat forming surface as shown in FIG. 4, or one of a number of cross-sectional configurations, including, for example, those shown in FIGS. 8*a*–8*g***.

A synthetic plastic closure member 50 is then mounted on the body one end, as shown in FIGS. 5 and 6. The closure member includes a generally disk shaped horizontal central portion 52 deformed to define an annular recess 54 having a frustoconical inner wall 56 and a vertical cylindrical outer wall 58. At its outer circumferential edge, the closure member includes an outer downwardly dependent flange portion 60 including a shoulder portion **60*a* which engages the outer surface of the reversely curled body end portion, and an annular stacking rib 62. An annular tearable locking rib 64 is connected with the lower edge of outer flange portion by a tearable weakened portion 66 of reduced thickness which defines on the inner circumferential surface of flange portion 60 an annular recess 68. As shown in FIG. 6, the recess 68 includes a generally horizontal bottom wall 70, and an upwardly converging side wall 72. When the closure member 50 is mounted on the reversely curled end portion of the body the locking projection 18*b* extends into the annular recess 68 to retain the closure member on the body one end. Owing to the resiliency of the reversely formed curl, the curl has a tendency to spring back radially outwardly, thereby to effect sealing engagement between the external curl surface and the converging side wall 72, between the double curled portion 18*d* and the outer surface of the tubular composite body wall, between the flat outer circumferential curl surface 20 and the closure shoulder portion 60*a*, between the upper extremity of the curl and the corresponding horizontal surface of the closure member, and the outer surface of the cover portion 58** and the adjacent inner surface of the body wall. The resilient pressure between the curled body one end and the closure member causes the seal between the body end and the closure member to be tighter and stronger than that which would be formed using a conventional synthetic plastic body member (such as that disclosed in the Ruch U.S. Pat. No. 3,753,511).

If desired, adhesive may be applied to selected areas of the formed curl to cause the curl to retain a desired shape after removal of the forming roll following the compressing step. Similarly, adhesive may be applied between the closure member and the body one end to more firmly hold the closure member on the container one end. It may be desirable to treat the fibrous layer with a suitable sealant material, such as QUILAN, thereby to protect the fibrous layer against moisture absorption.

In the embodiment of FIG. 7, instead of being double rolled as in the embodiments of FIGS. 5 and 6, the inner projecting portion is reversely curled radially outwardly and the upper portion of the curl is radially compressed inwardly to define an annular locking projection **18*b*′ that extends radially outwardly into the annular recess 68 of the closure member 50**.

As shown in FIG. 9, the tear strip 64 is preferably provided with a pull tab 80 defined by cut away portions 82 and 84 facilitate initiation of the tearing action by pulling of the tear tab 80 in the direction of the arrow, thereby allowing tearing to proceed in an easy and predictable manner. After removal of the tear strip, the remaining portion of the closure member is then lifted off to open the container.

The arrangement of the tear strip and annular locking projection afford the container tamper proof characteristics, since the closure may not be removed from the container end without first removing the tear strip. If pressure is applied to remove the closure member from the body end, the locking projection **18*b* will press against the flat surface 70 of the recess 64, thereby causing the weakened portion 66** to tear, whereby visible evidence of tampering is presented.

Referring now to FIGS. 10–12, in a preferred form, the synthetic plastic closure member 150 includes a center disk portion 152 that is deformed to define in its upper surface an annular recess 154 having a frustoconical inner wall 156 and a generally downwardly depending outer wall 158. The closure member includes an outer downwardly dependent cylindrical frange portion 160 that is provided on its inner surface with a plurality of circumferentially spaced radially inwardly directed locking ribs 161 that define at their upper ends the recess 168 for receiving the radially outwardly extending projection from the fibrous body wall member.

The outer surface of the downwardly depending recess wall 158 is provided with an annular rib 169 that is arranged to engage the inner surface of the body wall member as shown in phantom in FIG. 12. The tearable flange portion containing the locking ribs 161 is provided with a pull tab portion 180, as in the embodiment of FIG. 9. If desired, the locking rib means could comprise a continuous annular rib.

It is not necessary that the body wall member be skived at the end which is to be reversely rolled. In the double-rolled embodiment of FIGS. 13 and 14, the fibrous body wall member 200 is not skived prior to the reversely rolled step of FIG. 13 and the radially inwardly compressed step of FIG. 14. Similarly, in the single rolled embodiment of FIGS. 15 and 16, the body member 202 is not skived prior to the rolling and radially inwardly compressing steps.

Instead of using can seaming rolls to radially inwardly compress the upper extremity of the reversely rolled body wall portion, a stationary forming die 210 might be used as shown in FIG. 17. In this case, the lower surface of the forming die contains an annular recess 212 for axially receiving the rolled end of the container body wall 200, whereby the upper extremity of the reversely rolled portion is radially inwardly compressed owing to the specific cross-sectional configuration of the recess. Thus, owing to the inwardly converging outer side wall 212*a* of the recess, the upper extremity of the rolled body wall portion is radially inwardly compressed. If desired, the stationary forming die may be of sectional construction including a center section 210*a'* and four circumferentially arranged segments 210*b'*, as shown in FIG. 18.

While in accordance with the provision of the Patent Statutes, the preferred embodiments have been described, it will be understood that modifications and variations may be effected without departing from the spirit and scope of the novel concepts of this invention.

What is claimed is:

1. A method of forming a composite container including a vertically arranged tubular composite body wall, and a synthetic plastic end closure member, comprising the steps of (a) reversely curling outwardly the upper end of the composite body wall member; and (b) radially inwardly compressing only the outer circumferential surface of the uppermost extremity of the reversely curled portion toward the adjacent body wall member while simultaneously maintaining the inner circumferential wall surface thereof in a cylindrical configuration, thereby to cause the lower end of the reversely curled portion to project radially outwardly and thereby define an annular locking projection.

2. A method of forming a composite container as defined in claim 1, which further comprises the step of mounting a closure member on said body member one end, said closure member including an annular flange portion arranged concentrically about the reversely curled inner projecting portion, and an annular locking rib carried by said flange portion and extending in locking relation beneath said locking projection.

3. The method as defined in claim 2, and further including the preliminary step, prior to curling, of relieving the outer circumferential surface of the upper extremity of the body wall member, said relieved portion being reversely curled to a position in which the free extremity of the inner projecting portion extends in overlapping relation beyond the non-relieved portion of the body member, the upper extremity of the reversely rolled portion being compressed within the relieved area.

* * * * *